US012066267B1

(12) United States Patent
Williams et al.

(10) Patent No.: US 12,066,267 B1
(45) Date of Patent: Aug. 20, 2024

(54) SYSTEM FOR PIVOTING A BUFFER TUBE ASSEMBLY

(71) Applicant: Springfield, Inc., Geneseo, IL (US)

(72) Inventors: Charles David Williams, Geneseo, IL (US); Nathan A. Brinkmeyer, Le Claire, IA (US); Nick Ballard, Galva, IL (US); Benjamin Boyd McKelvain, Geneseo, IL (US)

(73) Assignee: Springfield, Inc., Geneseo, IL (US)

( * ) Notice: Subject to any disclaimer, the term of this patent is extended or adjusted under 35 U.S.C. 154(b) by 0 days.

(21) Appl. No.: 18/176,168

(22) Filed: Feb. 28, 2023

Related U.S. Application Data

(60) Provisional application No. 63/315,050, filed on Feb. 28, 2022.

(51) Int. Cl.
*F41C 23/04* (2006.01)
*F41A 3/66* (2006.01)
*F41A 3/84* (2006.01)

(52) U.S. Cl.
CPC ..... *F41A 3/66* (2013.01); *F41C 23/04* (2013.01); *F41A 3/84* (2013.01)

(58) Field of Classification Search
CPC ..... F41C 23/04
See application file for complete search history.

(56) References Cited

U.S. PATENT DOCUMENTS

| | | | | |
|---|---|---|---|---|
| 7,966,761 | B1 | 6/2011 | Kuczynko et al. | |
| 8,245,429 | B2 | 8/2012 | Kuczynko et al. | |
| 8,631,601 | B2 | 1/2014 | Langevin et al. | |
| 8,769,855 | B2 | 7/2014 | Law | |
| 8,955,422 | B1 | 2/2015 | Schumacher | |
| 8,991,088 | B1 | 3/2015 | Young | |
| 9,347,738 | B1 | 5/2016 | Schumacher | |
| 9,546,845 | B2 | 1/2017 | Mather | |
| 9,719,754 | B2 | 8/2017 | Law | |
| 10,113,832 | B2 | 10/2018 | Law | |
| 10,371,474 | B2 | 8/2019 | Young | |
| 10,704,848 | B1 | 7/2020 | Zeider et al. | |
| 11,015,885 | B1 | 5/2021 | Roth | |
| 11,143,470 | B1 * | 10/2021 | Roth | F41A 3/66 |
| 11,499,795 | B2 | 11/2022 | Law | |
| 2019/0339038 | A1 | 11/2019 | Law | |
| 2020/0191509 | A1 | 6/2020 | Young | |

* cited by examiner

*Primary Examiner* — Reginald S Tillman, Jr.

(74) *Attorney, Agent, or Firm* — Woodard, Emhardt, Henry, Reeves & Wagner, LLP

(57) ABSTRACT

A firearm assembly includes an upper receiver housing a bolt carrier group that is translatable within the upper receiver, and a lower receiver including a first hinge portion defining a first hinge opening. A second hinge portion is pivotally connected to the first hinge portion, and a buffer assembly is attached to the second hinge portion. A carrier block is positioned within the first hinge portion and is configurable in a blocking configuration and an unblocking configuration. A lock is configurable in a latched position and an unlatched position, and the lock is in mechanical communication with the carrier block when the lock is in the latched position. The carrier block is positioned in the unblocking configuration when the lock is in the latched position, and the carrier block is positioned in the blocking configuration when the lock is in the second position.

23 Claims, 22 Drawing Sheets

SYSTEM FOR PIVOTING A BUFFER TUBE ASSEMBLY

FIELD OF THE INVENTION

The present disclosure pertains generally to firearms. In particular, the present disclosure pertains to rifles or pistols having a reciprocating bolt.

BACKGROUND

At times, it may be desired to be able to reduce the length of a firearm to make the firearm easier to carry and/or to take up less room in storage. One way to reduce the length of a firearm is to make a stock or pistol stabilizing brace foldable, so that the stock or pistol stabilizing brace may be folded to one side of a receiver or frame of the firearm. This removes a length of the stock or pistol stabilizing brace from the overall length of the firearm, but keeps the stock or pistol stabilizing brace attached to the firearm so that the stock or pistol stabilizing brace may be easily reoriented for firing when a user wants to operate the firearm.

U.S. Pat. No. 10,704,848 to Zeider et al, titled RECEIVER WITH INTEGRAL HINGE FOR FOLDING BUFFER EXTENSION AND BUTT STOCK ASSEMBLY discloses a hinge mechanism having a fixed part integral to a lower receiver body of a firearm and a moving part to which a buffer tube is mounted. Other designs are disclosed in U.S. Pat. Nos. 8,769,855; 9,719,754; 10,113,832; 8,991,88; 10,371,474; and 11,143,470. There remains, however, a desire for new designs and improvement in this field.

SUMMARY OF THE INVENTION

The present disclosure pertains generally to firearms. In certain aspects, the present disclosure pertains to systems for firearms. In particular aspects, the present disclosure pertains to systems suitable for pivoting a buffer tube assembly relative to another portion of a firearm.

In certain aspects, at present disclosure pertains to systems for pivoting a buffer tube assembly relative to a receiver of a firearm, such as an AR-15, AR-10, and/or M-16 style firearm. The system may include a first hinge portion, a second hinge portion, a lock and a carrier blocking assembly. The first hinge portion is connected to and/or integral with a first portion of the firearm, such as a lower receiver and/or an upper receiver. The second hinge portion may be connected to and/or integral with the buffer tube assembly of the firearm (e.g., the second hinge portion may be integral with a buffer tube).

The second hinge portion is at least pivotably connected to the first hinge portion and movable from a first position relative to the first hinge portion to a second position relative to the first hinge portion. In the first position, a longitudinal axis of the buffer tube assembly is parallel (e.g., co-axial) with a longitudinal axis of the bolt assembly (e.g., bolt carrier group) of the firearm. In the second, folded position, the longitudinal axis of the buffer tube assembly may be transverse to the longitudinal axis of the bolt assembly or parallel but laterally spaced away therefrom. Movement of the second hinge portion relative to the first hinge portion is preferably rotational movement. Alternatively, movement of the second hinge portion relative to the first hinge portion may be translational movement and/or a combination of rotational and translational movement.

The lock (e.g., a latch) is configurable between a first condition and a second condition. In the first condition, the lock is capable of locking the second hinge portion in the first position relative to the first hinge portion. Preferably, the lock is configured to lock the second hinge portion in the first position simultaneously and/or after the second hinge portion configures from the second, folded position into the first position. Movement of the second hinge portion from the second, folded position to the first position may configure the lock from the second, unlatched condition into the first condition. Preferably, the lock may be disengaged to allow the second hinge portion to move from the first position to the second position.

The carrier blocking assembly is configurable from a first configuration to a second configuration. In the first configuration, the carrier blocking assembly is configured to permit rearward movement of the bolt assembly. In the second configuration, the carrier blocking assembly is configured to resist rearward movement of a bolt assembly of the firearm (e.g., a bolt carrier group).

Preferably, the lock is in the first condition and locking the second hinge portion in the first position relative to the first hinge portion when the carrier blocking assembly is in the first configuration. Preferably, the lock enters the first condition before and/or simultaneously with the carrier blocking assembly configuring into the first configuration.

The lock is preferably biased towards the first condition. Preferably, the lock is biased by a spring towards the first condition.

The carrier blocking assembly is preferably in the second configuration when the lock is in the second condition. Preferably, even if the second hinge portion is in the first position the carrier blocking assembly is in the second configuration when the lock is in the second condition. More preferably, the carrier blocking assembly configures into the second configuration before the lock enters the second condition (e.g., before the lock leaves the first condition). Advantageously, such arrangements can ensure the carrier blocking assembly is in the second configuration when the second hinge portion is not in the first position (e.g., when the buffer tube assembly is not in alignment with the bolt carrier group) and/or if the lock is not in the first condition.

Preferably, configuring the lock into the first condition configures the carrier blocking assembly into the first configuration. Preferably, configuring the lock from the first condition towards the second condition allows the carrier blocking assembly to configure into the second configuration. Preferably, the lock configures the carrier blocking assembly into the second configuration before and/or during configuring the lock from the first condition to the second condition. Preferably, the lock and not the second hinge portion configures the carrier blocking assembly into the first configuration.

The carrier blocking assembly can comprise a carrier block and an actuation pin. The carrier block may pivot about a first axis between the first configuration and the second configuration. Preferably, the actuation pin actuates the carrier block around the first axis. The actuation pin may be actuated by the lock to actuate the carrier block. The carrier block and/or actuation pin may be biased into the second configuration by a spring.

Further forms, objects, features, aspects, benefits, advantages, and embodiments of the present invention will become apparent from a detailed description and drawings provided herewith.

DETAILED DESCRIPTION

Figure 1:
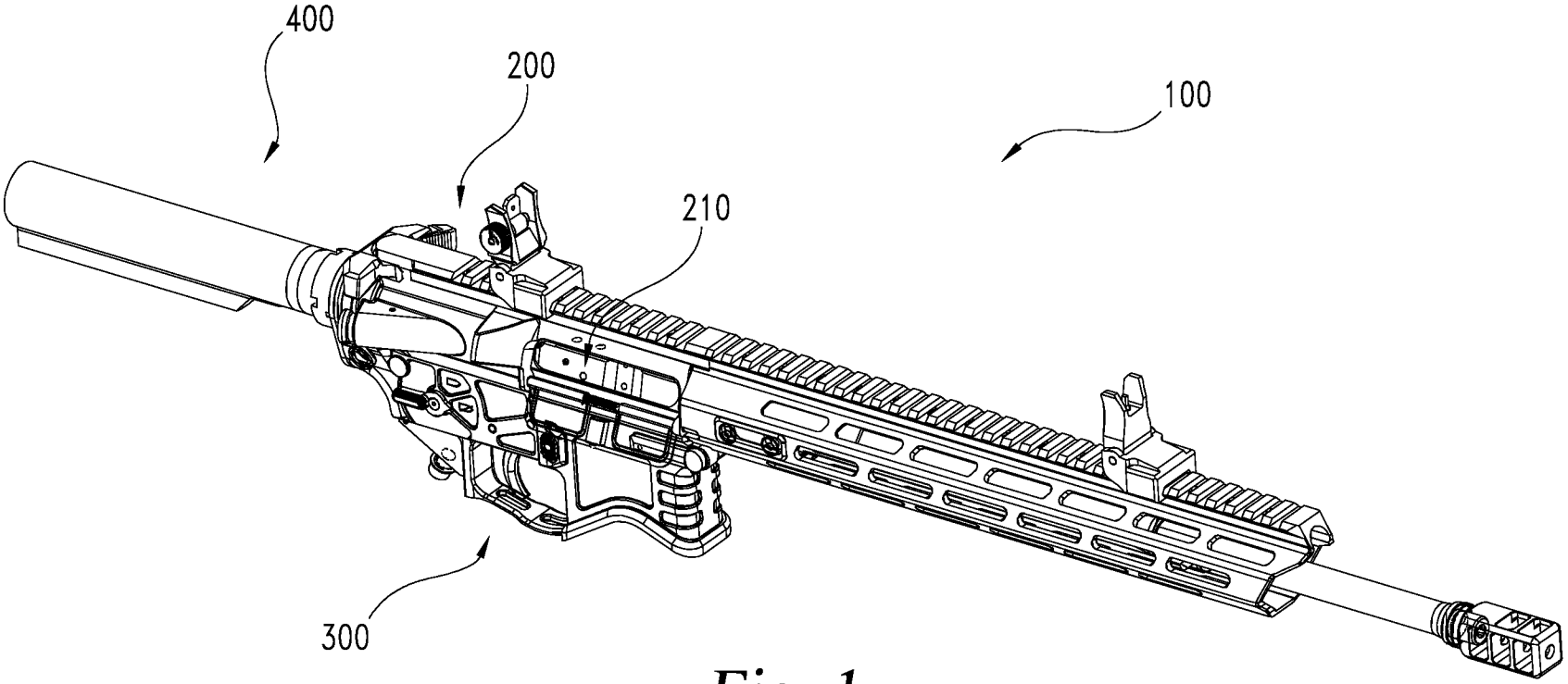
FIG. 1 is a front-right perspective view of a firearm assembly.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

FIG. 1 illustrates a firearm assembly 100. The firearm assembly comprises an upper receiver 200 positioned atop a lower receiver assembly 300. A bolt carrier group 210 is positioned within the upper receiver 200. A buffer tube assembly 400 is attached to the lower receiver assembly 300 and extends rearwardly with respect to the upper receiver 200 and the lower receiver assembly 300.

Figure 2:
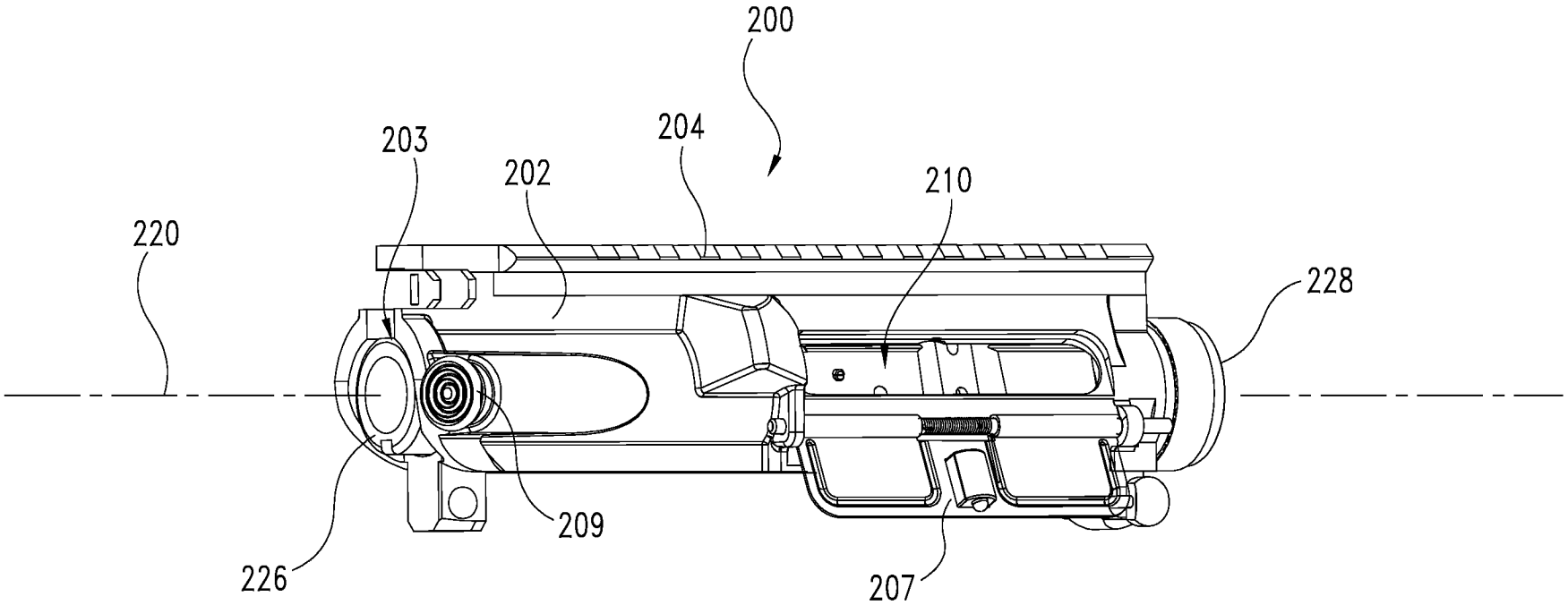
FIG. 2 is a rear-right perspective view of an upper receiver assembly of FIG. 1.

FIG. 2 illustrates a portion of the upper receiver 200. The upper receiver 200 includes an upper receiver body 202 that defines an upper receiver interior 203 within the upper receiver body 202. The upper receiver body 202 includes a rearward surface 226 that interfaces with the buffer tube assembly 400 when the firearm assembly 100 is assembled. The upper receiver body 202 also includes a forward surface 228 that interfaces with a barrel of the firearm assembly 100. As shown, the bolt carrier group 210 is positioned within an interior 203 of the upper receiver 200 and is movable within the upper receiver interior 203. For example, during operation of the firearm, the bolt carrier group translates or reciprocates within the upper receiver along a longitudinal axis 220.

A rail 204 may be positioned on the upper receiver body 202. The rail 204 may be used for attachment of accessories to the upper receiver 200. The rail 204 may be a Picatinny rail, dovetail, M-LOK, or any other suitable rail system. The upper receiver assembly also includes a dust cover 207 and a forward assist 209. The dust cover 207 may be positioned in an open orientation that allows access to the bolt carrier group 210 within the upper receiver interior 203, or the dust cover 207 may be positioned in a closed orientation that may prevent dirt and other objects from getting into the upper receiver interior 203 and interfering with operation of the bolt carrier group 210.

Figure 3:
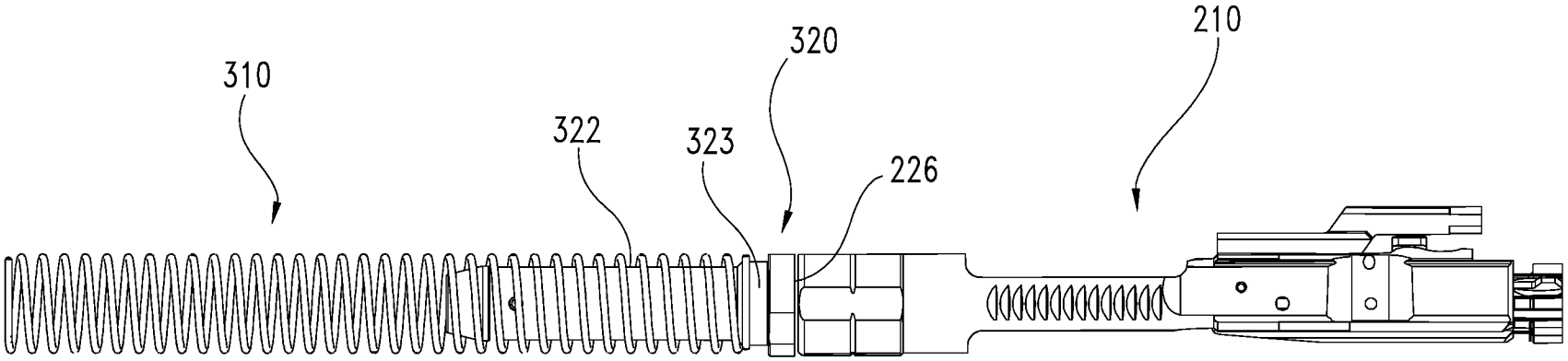
FIG. 3 is a side view of a bolt carrier group, buffer assembly, and buffer spring of FIG. 1.

FIG. 3 illustrates the bolt carrier group 210 and portions of the buffer tube assembly 400, namely a buffer spring 310 and a buffer assembly 320. The buffer assembly 320 includes a buffer 322 that has a buffer connection end 323. The buffer spring 310 at least partially surrounds the buffer 322, and may extend rearwardly with respect to the buffer 322. In some embodiments, as shown, the buffer spring 310 may not surround the buffer connection end 323. The buffer connection end 323 of the buffer assembly 320 contacts a rearward surface 226 of the bolt carrier group 210 and, in combination with the buffer spring 310, provides resistance and return force to the bolt carrier group 210 during operation the firearm.

Figure 4:
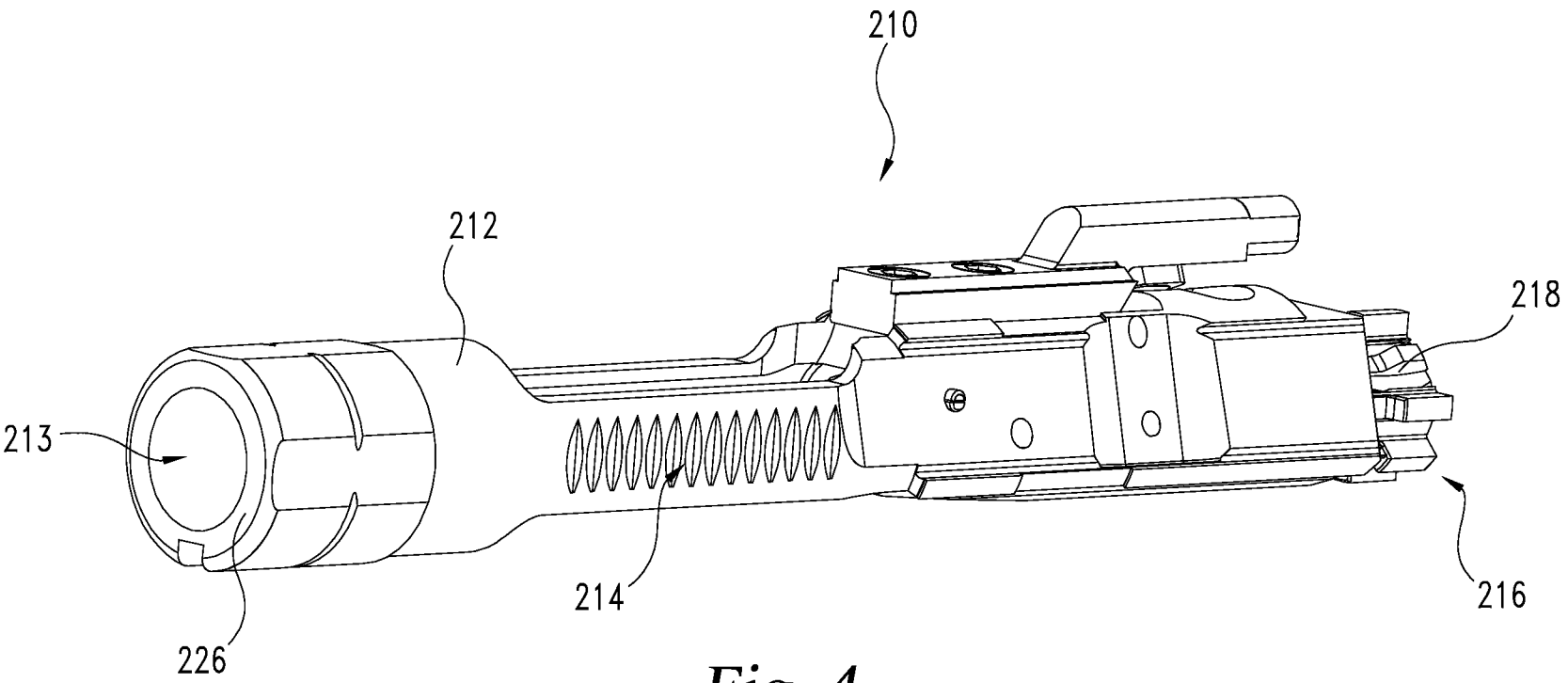
FIG. 4 is a rear-right perspective view of the bolt carrier group of FIG. 3.

FIG. 4 illustrates the bolt carrier group 210 and the rearward surface 226 of the bolt carrier that contacts the buffer assembly. As shown, the bolt carrier group 210 includes a bolt carrier 212. The bolt carrier 212 defines a bolt carrier opening 213 that extends through bolt carrier 212 along the longitudinal axis 220. A bolt 216 including an extractor 218 is fit at least partially within the bolt carrier opening 213. A firing pin may be fit into an opening defined through the bolt 216. A series of forward assist notches 214 are defined on one side of the bolt carrier 212. The forward assist notches 214 interact with the forward assist 209 to allow the bolt carrier group 210 to be moved in a forward direction when the forward assist 209 is operated.

Figure 5:
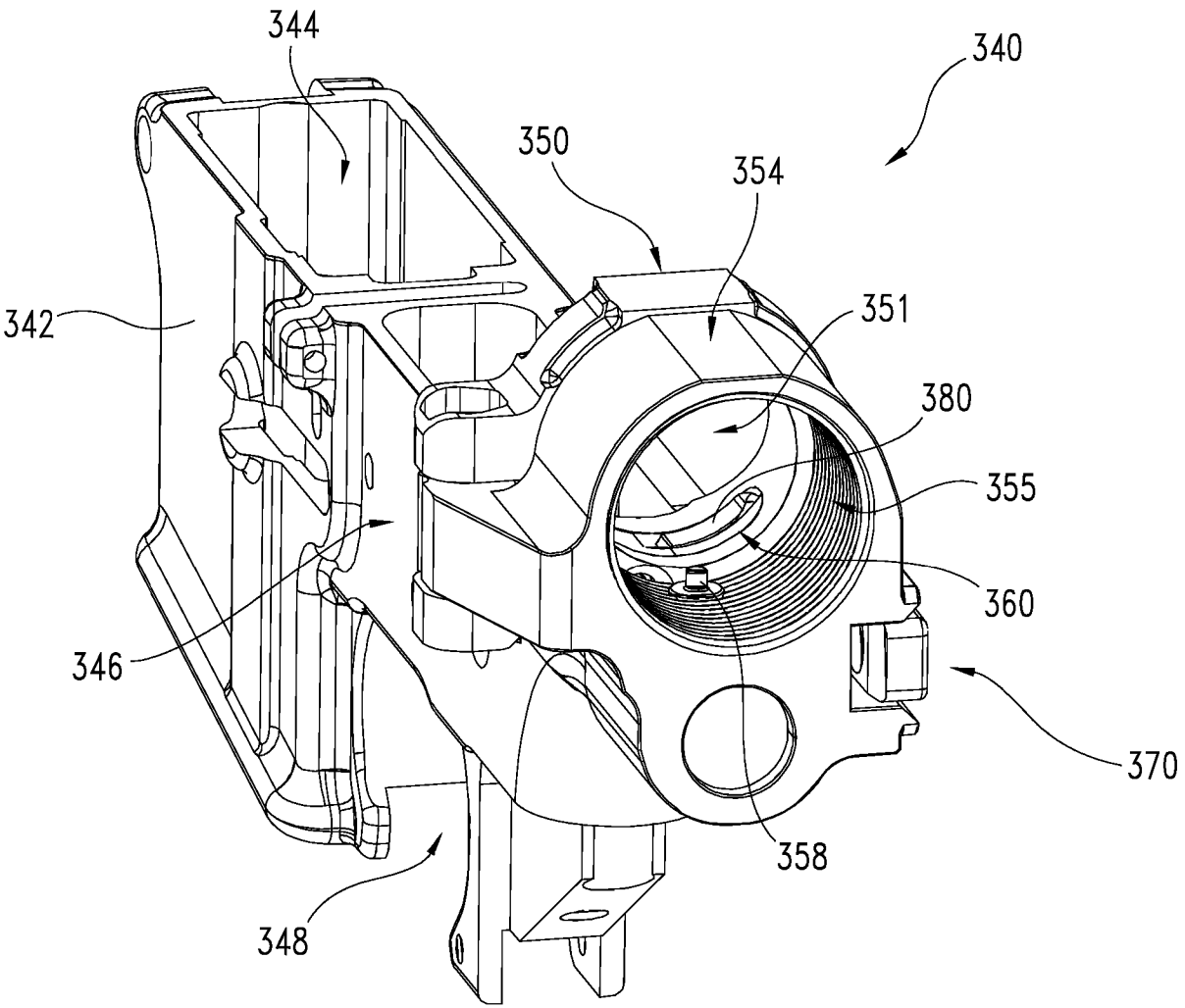
FIG. 5 is rear-left perspective view of a lower receiver and system for pivoting the buffer tube assembly in a first (e.g., unfolded) configuration.
Figure 6:
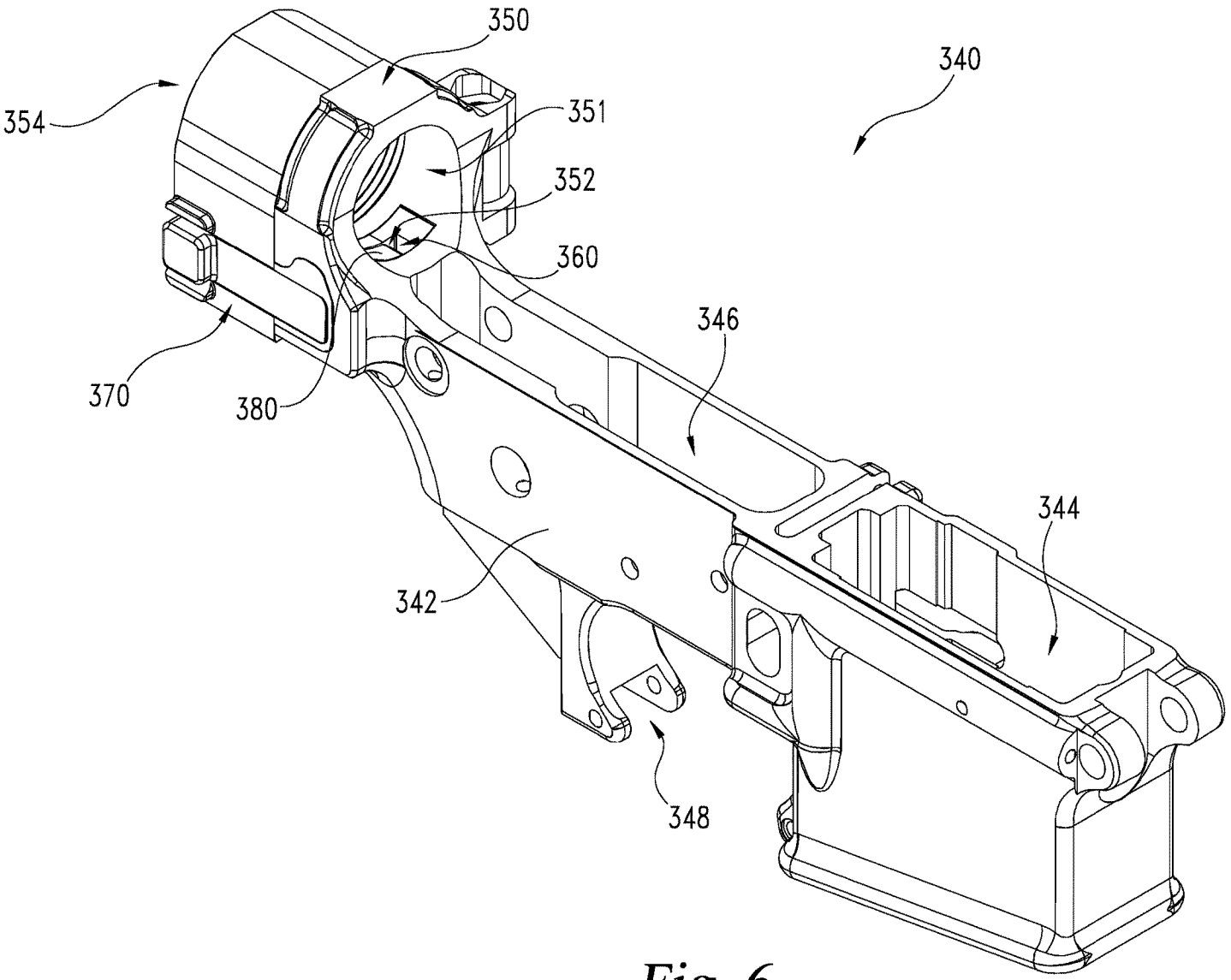
FIG. 6 is a front-right perspective view of the lower receiver and system of FIG. 5.
Figure 7:
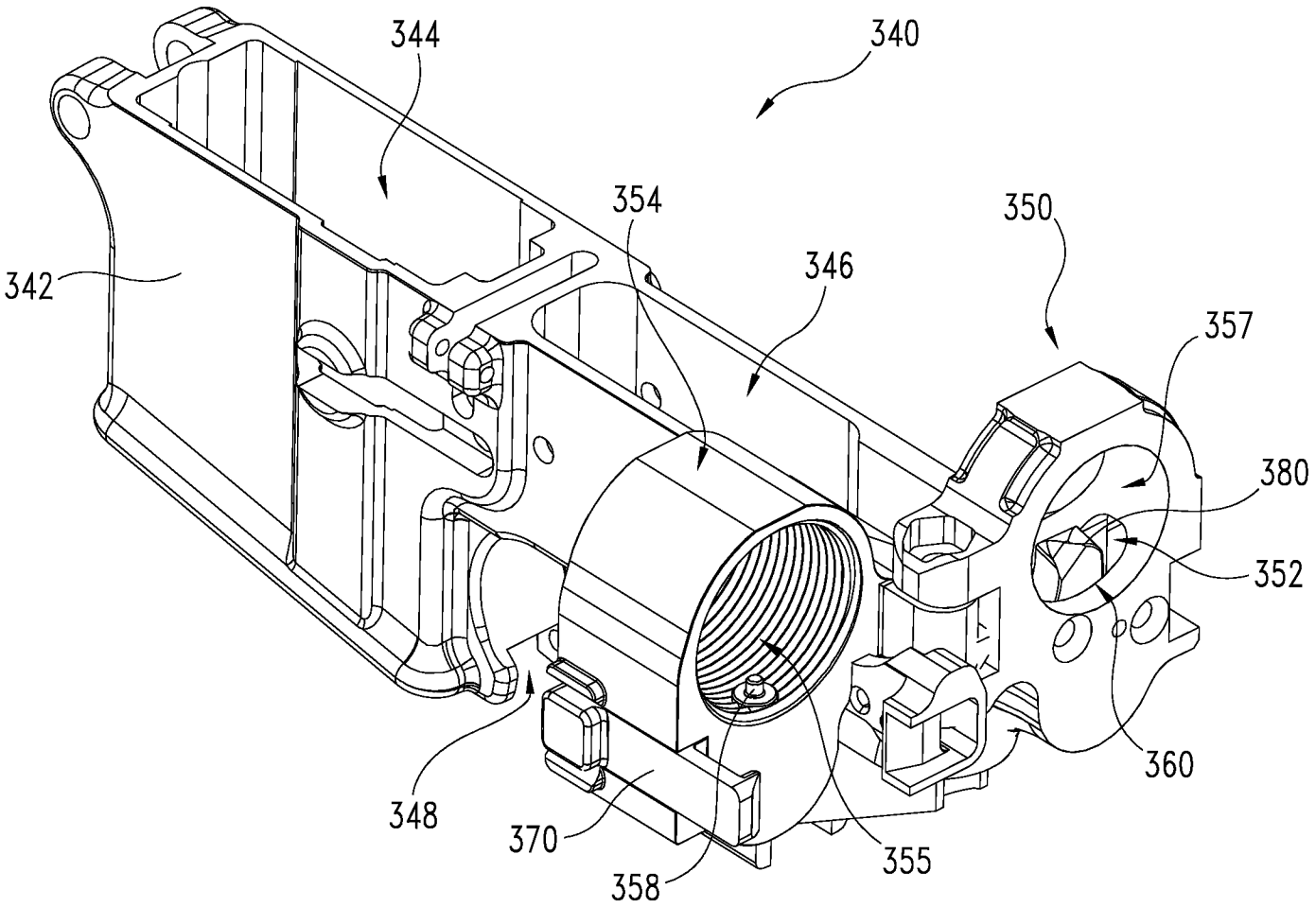
FIG. 7 is a rear-left perspective view of the lower receiver and system of FIG. 5 in a second (e.g., folded) configuration.
Figure 8:
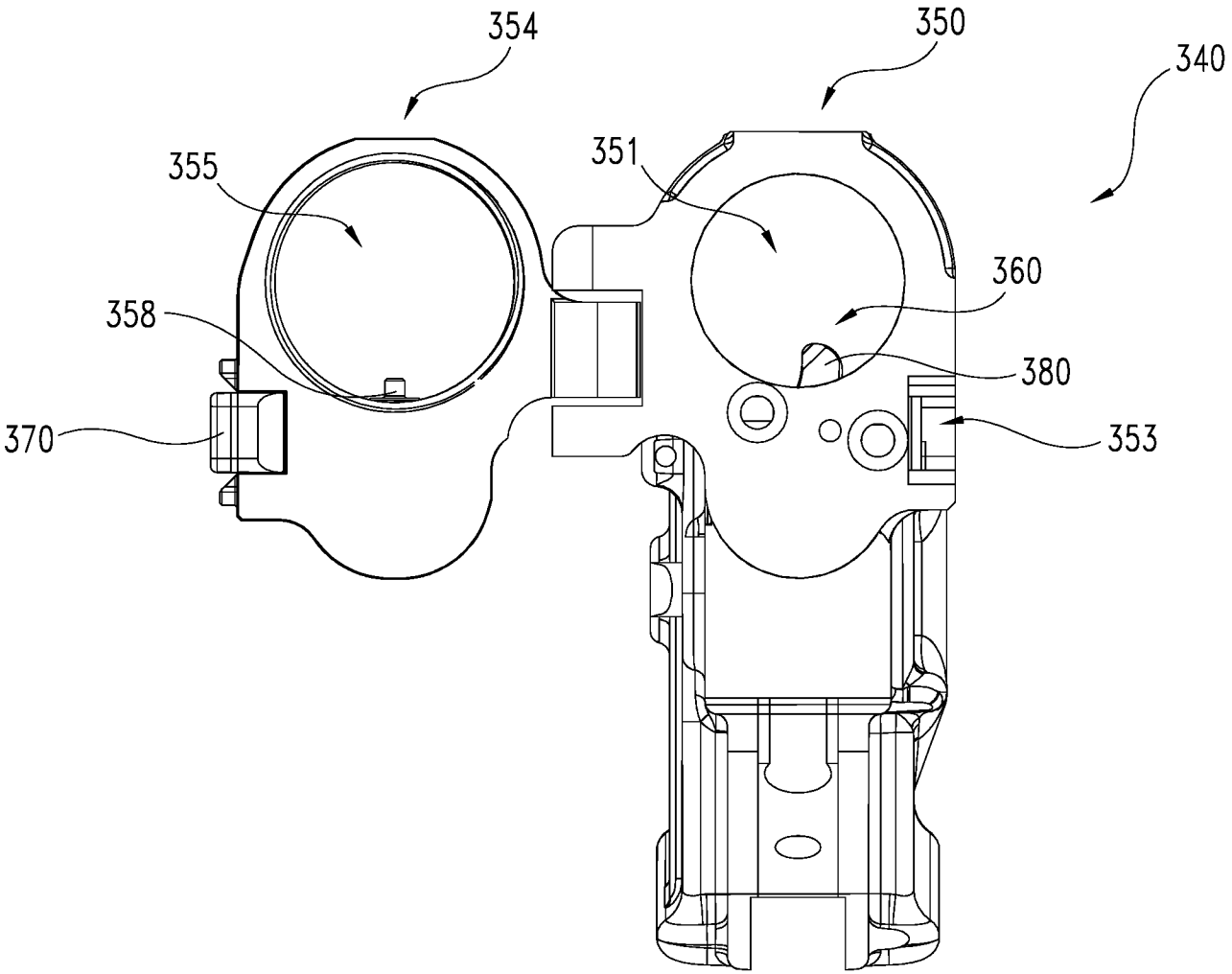
FIG. 8 is a rear view of the lower receiver and system of FIG. 7.
Figure 9:
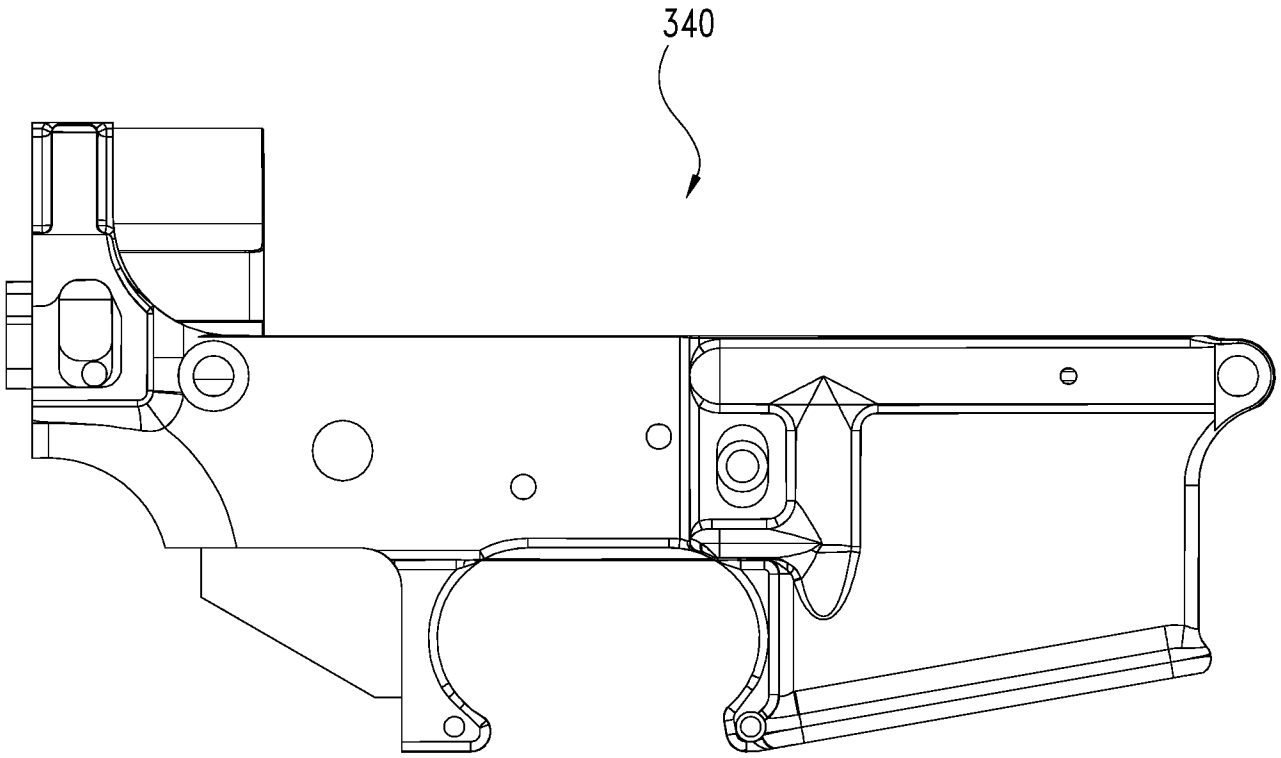
FIG. 9 is a right side view of the lower receiver and system of FIG. 7.
Figure 10:
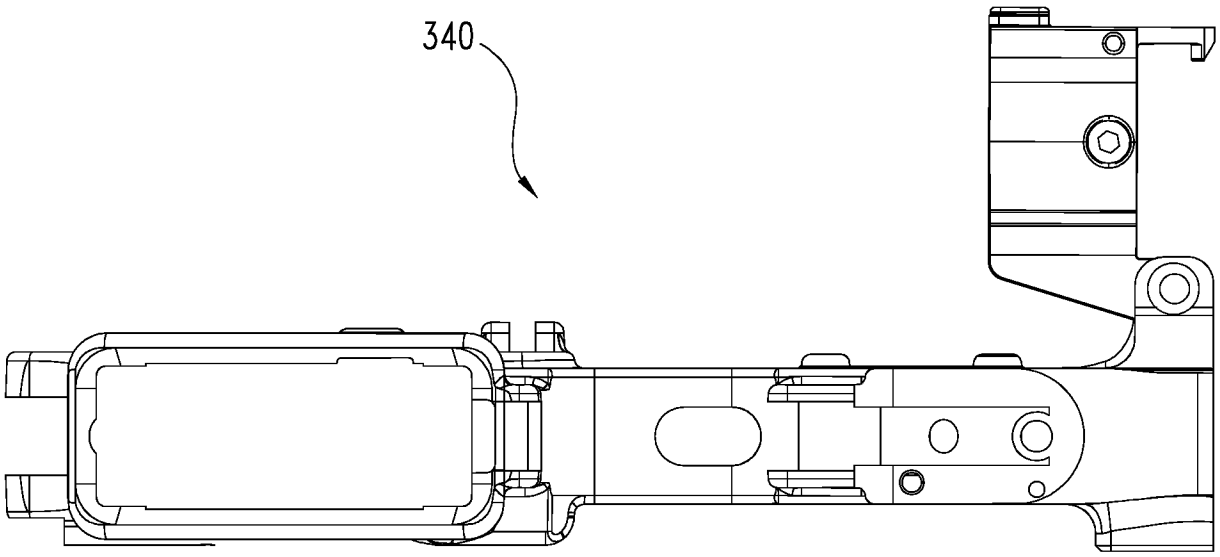
FIG. 10 is a bottom view of the lower receiver and system of FIG. 7.

FIGS. 5 and 6 illustrate a lower receiver 340 of the lower receiver assembly the firearm. The lower receiver 340 includes a lower receiver body 342 and defines a magazine well 344 for receiving a magazine. The lower receiver also includes a trigger housing 346 which holds and supports a trigger assembly of the firearm assembly 100 within the lower receiver 340. A trigger guard 348 portion of the lower receiver 340 protects and partially surrounds a trigger of the trigger assembly.

The lower receiver 340 includes a first hinge portion 350. In the embodiment shown, the first hinge portion 350 is located at the rearward end of the lower receiver 340. The first hinge portion 350 defines a first hinge opening 351. The first hinge opening 351 is aligned with the longitudinal axis 220 defined by the upper receiver 200. In the illustrated embodiment, a first hinge portion 350 of the disclosed system is integral in the lower receiver. However, in other embodiments the first hinge portion 350 may be a separate component that is attachable to the lower receiver 340. In still other embodiments, the first hinge portion 350 may be coupled to or integral to the upper receiver 200.

A second hinge portion 354 is pivotally connected to the first hinge portion 350. The second hinge portion 354 defines a second hinge opening 355. In FIGS. 5 and 6, the second hinge portion 354 is shown in a first, unfolded position relative to the first hinge portion 350. When the second hinge portion 354 is arranged in the unfolded position, the second hinge opening 355 is aligned with the first hinge opening 351. Therefore, when the first hinge opening 351 is aligned with the longitudinal axis 220, then the second hinge opening 355 is also aligned with the longitudinal axis 220 when the second hinge portion is in the unfolded position.

Also illustrated in FIGS. 5 and 6, a carrier blocking assembly 360 includes a lock 370 and a carrier block 380. In the embodiment shown, the lock 370 is arranged in a first latched condition. In the latched condition, the lock spans between the first hinge portion 350 and the second hinge portion 354 when the first hinge portion 350 and the second hinge portion 354 are arranged in the unfolded position and retains the first hinge portion 350 and the second hinge portion 354 in the unfolded position. The carrier block 380 is arranged in a first, unblocking configuration. The carrier block 380 is positioned within a carrier blocking recess 352 defined through a surface of the first hinge portion 350. While in the unblocking configuration, the carrier block 380 is positioned within the carrier blocking recess 352 so that the carrier block 380 does not extend into the first hinge opening 351 defined through the first hinge portion 350.

FIGS. 7 through 10 illustrate the second hinge portion 354 in a second, folded position relative to the first hinge portion 350 and the carrier blocking assembly 360 with the carrier block 380 arranged in a second, blocking configuration. As shown, the second hinge portion 354 is pivoted with respect to the first hinge portion 350 to move the second hinge portion 354 from the unfolded position to the folded position. In the embodiment shown, the second hinge portion 354 is rotated about 180 degrees when moved from the folded position to the unfolded position. The lock 370 pivots with the second hinge portion 354, vacating a lock recess 353 defined in the first hinge portion 350.

Also, as illustrated in FIGS. 7 through 10, when the carrier block 380 is in the second, blocking configuration, at least a portion of the carrier block 380 extends into the first hinge opening 351. The positioning of a portion of the carrier block 380 in the first hinge opening 351 may act to prevent rearward movement of the bolt carrier group 210 past the first hinge portion 350 of the lower receiver 340. As the bolt carrier group 210 translates or reciprocates rearwardly, the carrier block 380 acts as a stop that prevents or resists the bolt carrier group 210 from extending through the first hinge opening 351.

Figure 11:
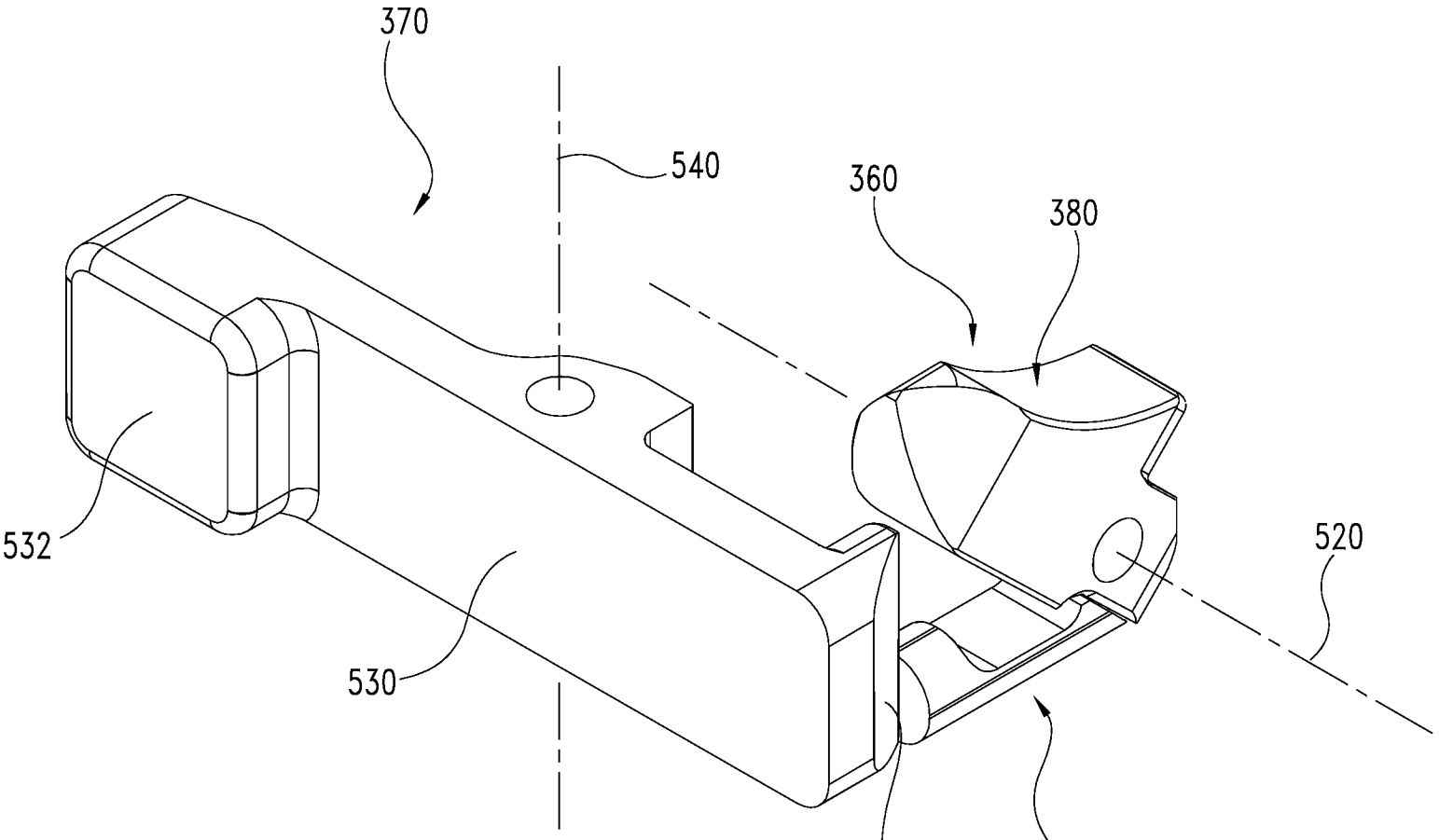
FIG. 11 is a front-right perspective view of the lock and blocking lever and actuation pin of the bolt blocking assembly of FIG. 5.
Figure 12:
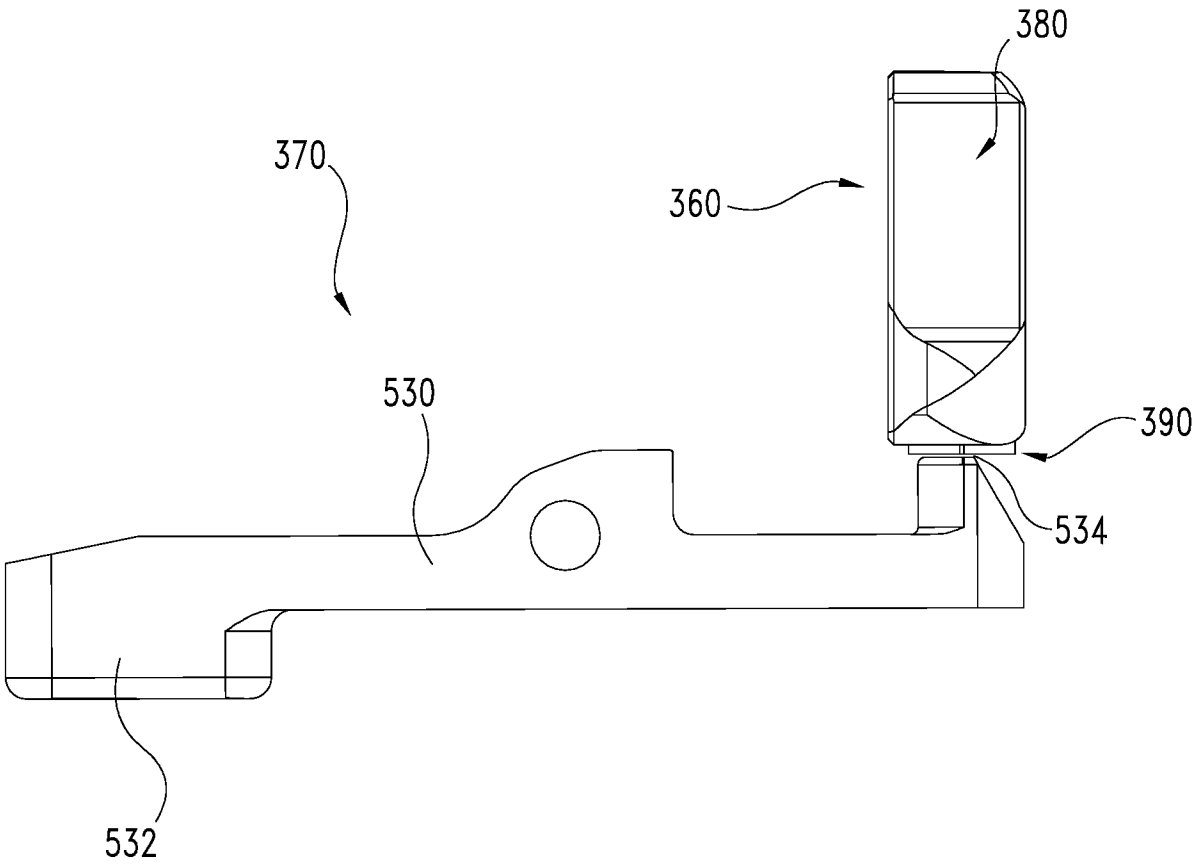
FIG. 12 is a top view of the system of FIG. 11.
Figure 13:
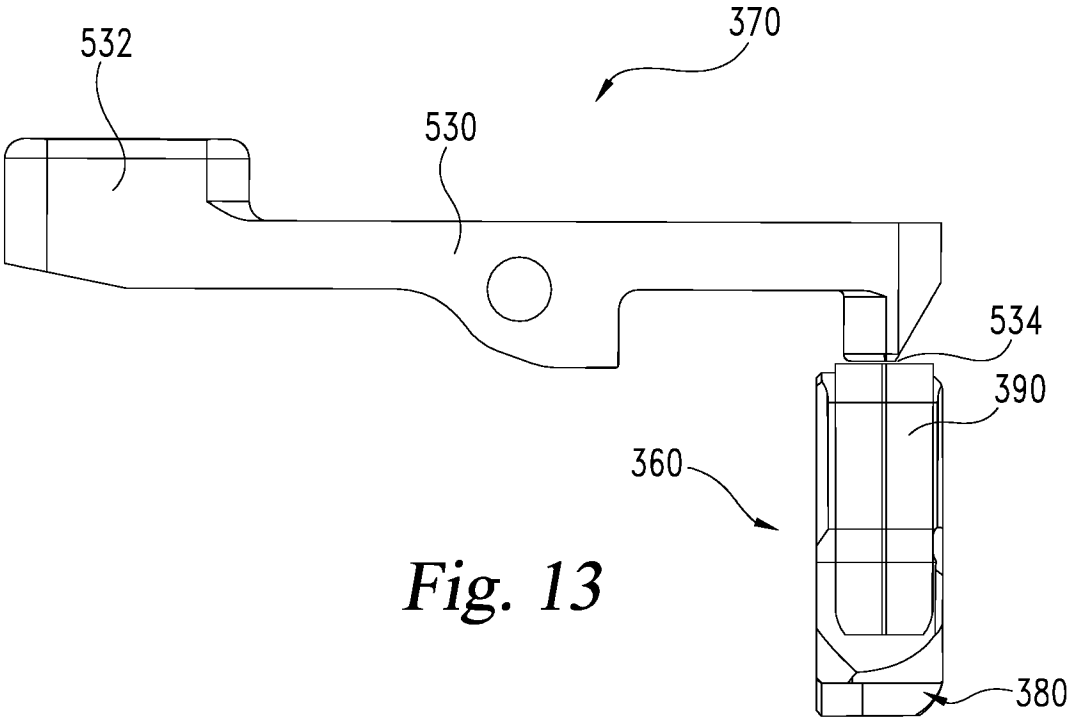
FIG. 13 is a bottom view of the system of FIG. 11.

FIGS. 11 through 13 illustrate the lock 370 in the first, latched condition and the carrier blocking assembly 360 in the first, unblocking configuration. The carrier blocking assembly 360 comprises the carrier block 380 and an actuation pin 390. The carrier block 380 may pivot around about a first axis, for example, a carrier block axis 520. The carrier block 380 may pivot about the carrier block axis 520 between the first, unblocking configuration and the second, blocking configuration. When the carrier blocking assembly 360 is in the second, blocking configuration, a forward-facing surface of the carrier block 380 is positioned rearward of the rearward surface 226 of the bolt carrier group 210 so as to block rearward travel of the bolt carrier group 210.

The lock 370 includes a lever 530, and a lock button 532 extending from a surface of the lever 530 at a first end of lever 530. A lock actuation surface 534 is positioned at an opposite end of the lever 530. The lever 530 of the lock 570 is pivotable about a second axis, for example, a lock axis 540. The lock actuation surface 534 of the lever 530 may contact and actuate the actuation pin 390. Actuation of the actuation pin 390 may, in turn, actuate the carrier block 380, causing the carrier block to pivot around the carrier block axis 520.

Figure 14:
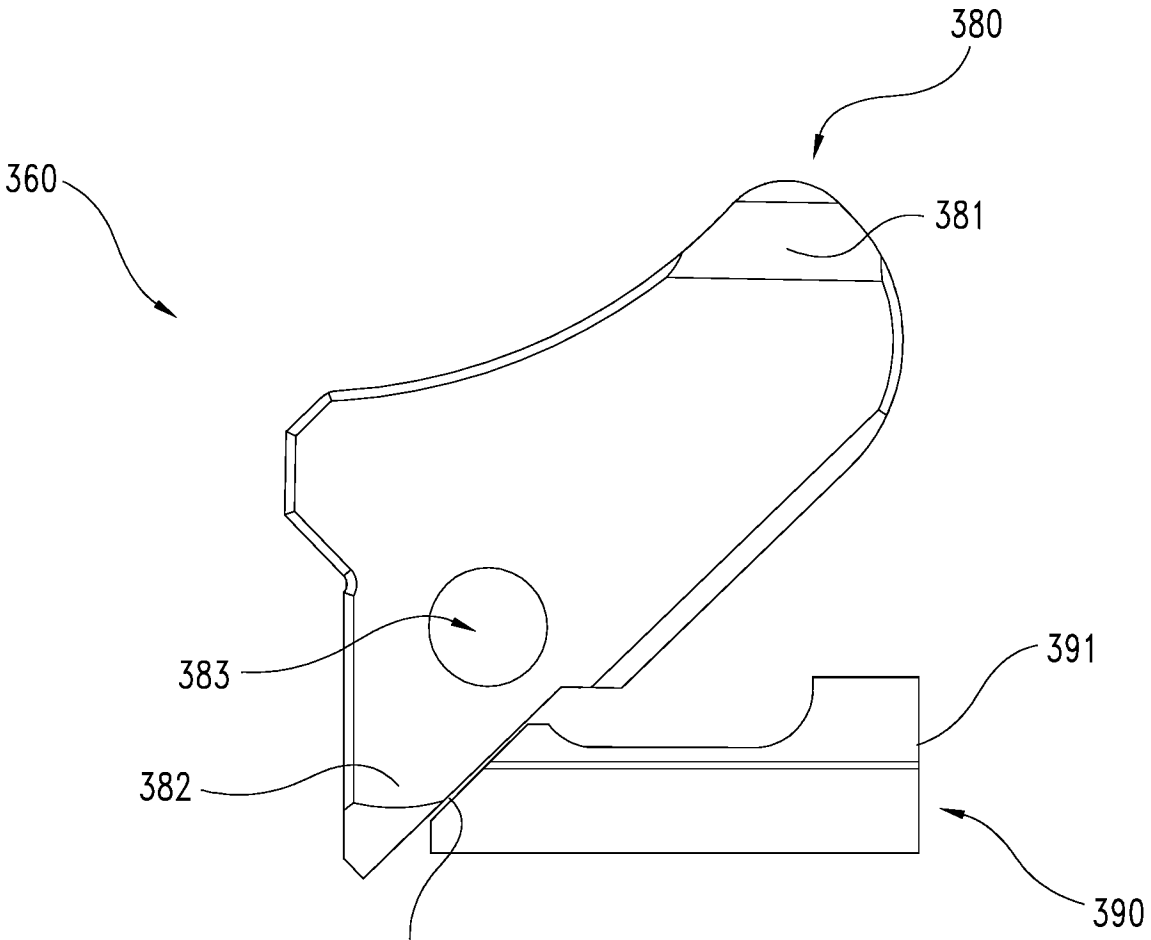
FIG. 14 is a rear view of the system of FIG. 11 (i.e., in the first configuration).
Figure 15:
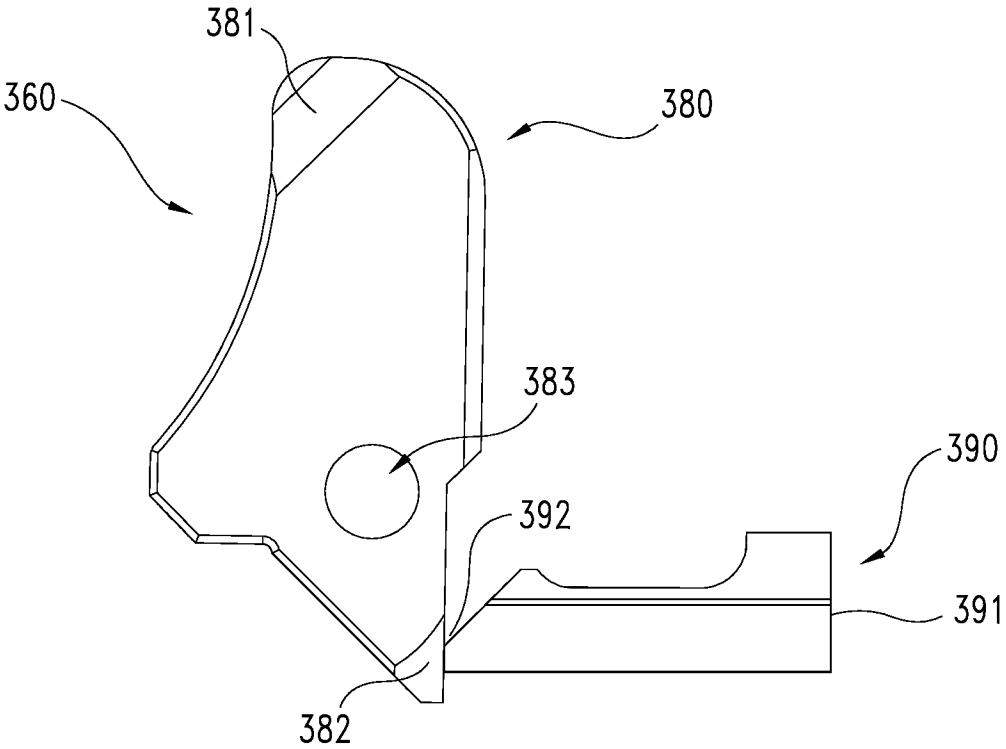
FIG. 15 is a rear view of the system of FIG. 8 (i.e., in the second configuration).
Figure 16:
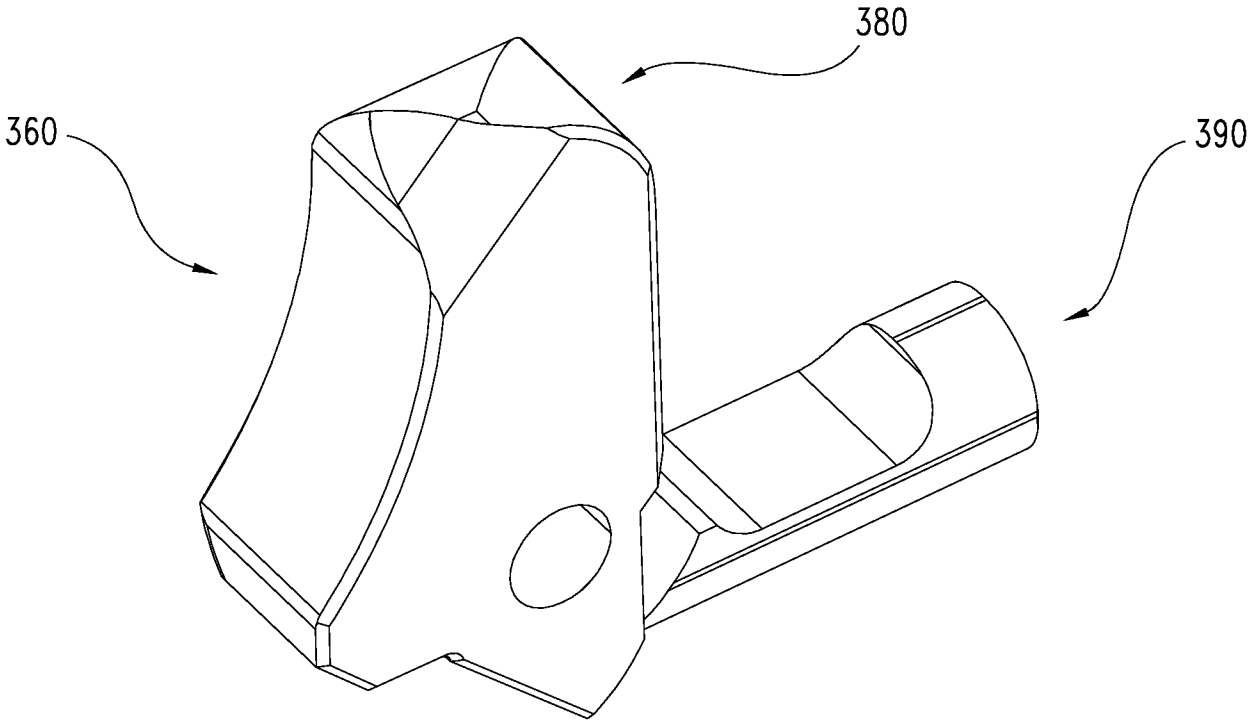
FIG. 16 is a left rear perspective view of the system of FIG. 15.
Figure 17:
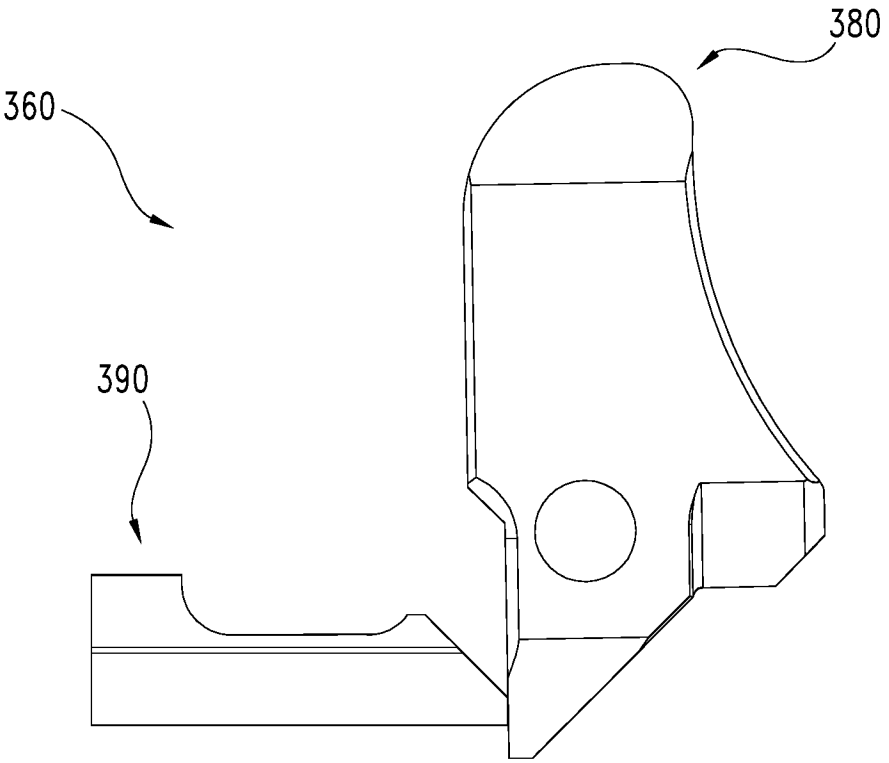
FIG. 17 is a front view of the system of FIG. 16.
Figure 18:
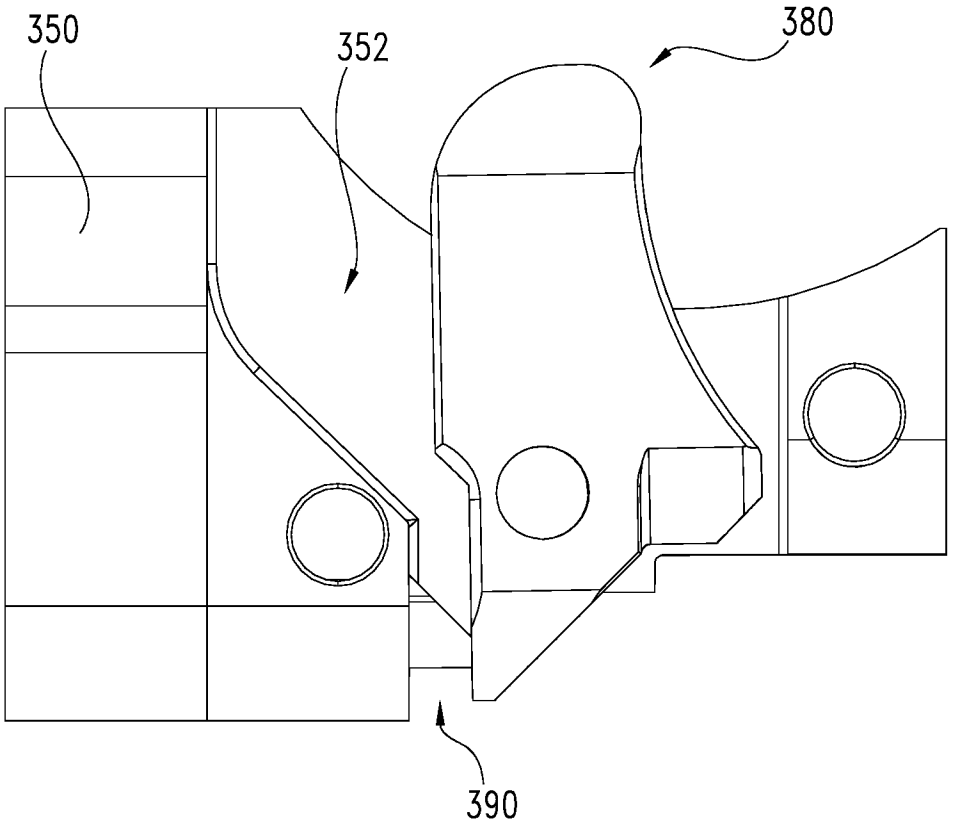
FIG. 18 is a front view of the system of FIG. 16 as supported by a support block in a bolt blocking assembly.
Figure 19:
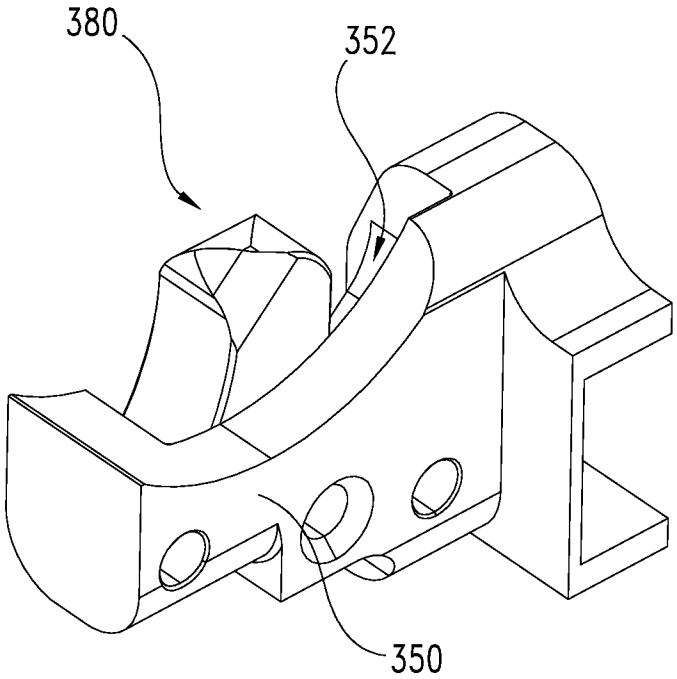
FIG. 19 is a rear-left perspective view of the system of FIG. 18.
Figure 20:
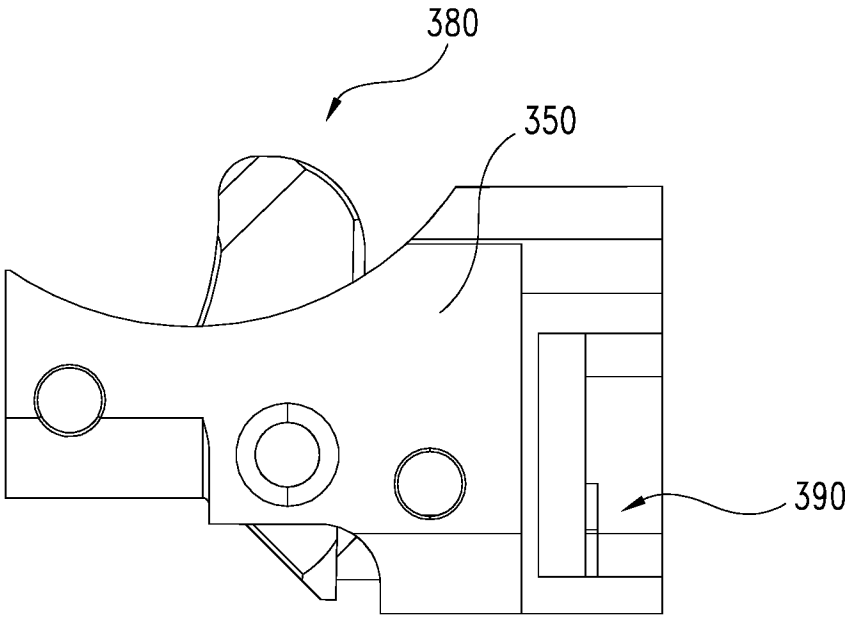
FIG. 20 is a rear view of the system of FIG. 18.

FIG. 14 illustrates the carrier blocking assembly 360 arranged in the first, unblocking configuration. The carrier block 380 includes a blocking portion 381 and a lever actuation portion 382. The carrier block 380 also defines a carrier block opening 383 through which a pin, a bearing, or other suitable component may be inserted to allow rotation of the carrier block 380 about the carrier block axis 520. The actuation pin 390 includes a lock actuation end 391 for interfacing with the lock actuation surface of the lock 570, and the actuation pin includes a lever actuation end 392 for interfacing with the carrier block 380.

As shown in FIG. 14, the actuation pin 390 may be moved toward the lever actuation portion 382 so that the lever actuation end 392 of the actuation pin 390 contacts and applies a force on the lever actuation portion 382 of the carrier block 380. This force causes the carrier block 380 to rotation about the carrier block axis 520. From the view shown in FIG. 14, the carrier block 380 rotates clockwise about the carrier block axis 520, lowering the blocking portion 381 of the carrier block 380.

FIGS. 15 through 20 illustrate portions of the carrier blocking assembly 360 in the second, blocking configuration. As shown, the actuation pin 390 is pulled away from the lever actuation portion 382, releasing at least a portion of the force applied on the carrier block 380 by the actuation pin 390. As the force is released from the carrier block 380, the carrier block 380 rotates counter-clockwise about the carrier block axis 520 with respect to the view shown in FIG. 15, raising the blocking portion 381 of the carrier block 380. As the carrier block rotates, the blocking portion 381 of the carrier block 380 may raise into the first hinge opening 351 defined through first hinge portion 350. The blocking portion 381 of the carrier block 380 positioned within the first hinge opening 351 may prevent translation of the bolt carrier group 210 rearward, past the first hinge portion. In some embodiments, the carrier block 380 and/or actuation pin 390 may be biased into the second, blocking configuration by a spring, so that the carrier block 380 remains in the blocking configuration when no force is applied on the carrier block 380 by the actuation pin.

Figure 21:
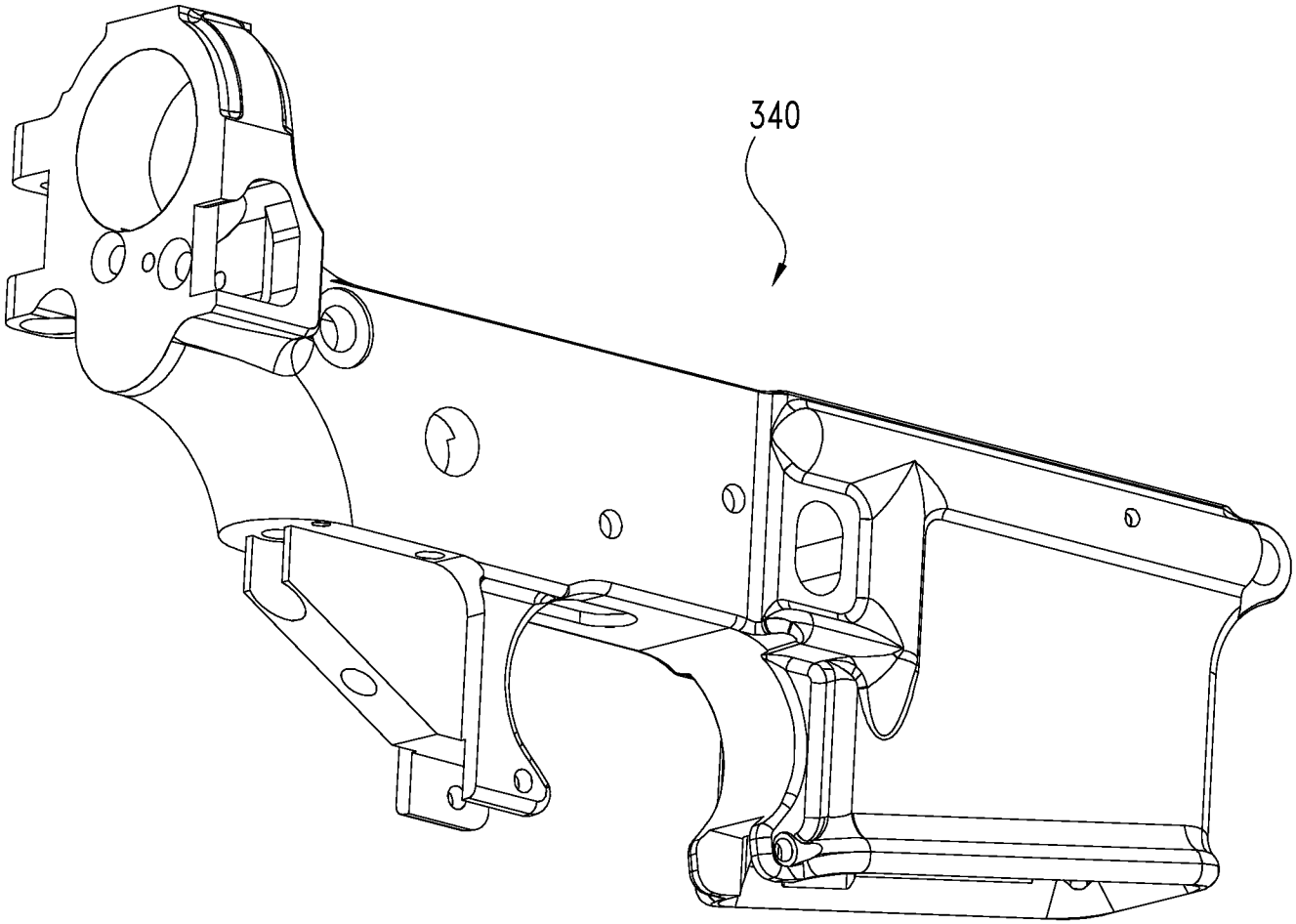
FIG. 21 is a rear-right perspective view of the lower receiver of FIG. 5.
Figure 22:
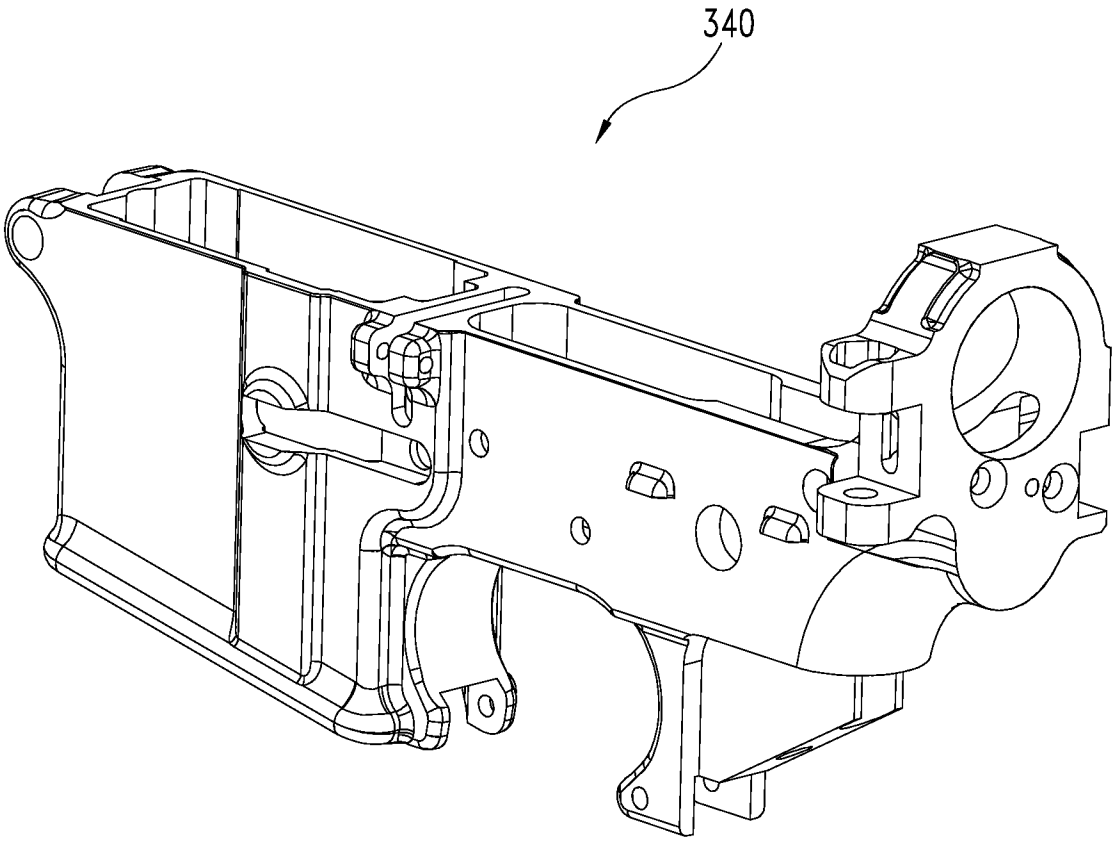
FIG. 22 is a rear-left perspective view of the lower receiver of FIG. 5.

FIGS. 21-22 illustrate the lower receiver 340.

In operation, the buffer tube assembly 400 is folded with respect to the upper receiver 200 and the lower receiver assembly 300 by moving the lock 370 from the latched condition to the unlatched condition. While in the latched condition, the lock 370 secures the first hinge portion 350 to the second hinge portion 354, but moving the lock 370 to the unlatched condition allows the second hinge portion 354 to hinge with respect to the first hinge portion 350. In some embodiments, the lock 370 may be unlatched by pressing the lock button 532, allowing the lever 530 of lock 570 to rotate about the lock axis 540. After the lock 370 has been moved into the unlatched condition, the second hinge portion 354 may be pivoted with respect to the first hinge portion 350. In some embodiments, the second hinge portion 354 may be rotated 180 degrees with respect to said first hinge portion 350 so that the buffer tube assembly is positioned alongside the lower receiver assembly 300.

As the second hinge portion 354 is pivoted with respect to the first hinge portion 350, the lock 370 is removed from the lock recess 353 of the first hinge portion 350. This causes the lever 530 of the lock 370 to lose contact with the actuation pin 390 of the carrier blocking assembly 360 and release the force applied on the actuation pin 390 by the lever 530. In turn, the actuation pin 390 may be biased to translate in a direction away from the lever actuation portion 382 of the carrier block 380. This causes the carrier block 380 to rotate about the carrier block axis 520 so that the blocking portion 381 of the carrier block 380 moves into the blocking configuration in which at least a portion of the carrier block is positioned within the first hinge opening 351. When the blocking portion 381 of the carrier block 380 is positioned within the first hinge opening 351, the carrier block 380 may prevent rearward movement of the bolt carrier group 210 so that the bolt carrier group 210 may not move rearwardly past the first hinge portion 350.

The buffer tube assembly 400 is moved from a folded configuration to an unfolded configuration with respect to the upper receiver 200 and the lower receiver assembly 300 by pivoting the second hinge portion 354 with respect to the first hinge portion 350. In some embodiments, the second hinge portion 354 may be rotated 180 degrees with respect to the first hinge portion 350. In the unfolded configuration, the second hinge portion 354 is aligned with the first hinge portion 350 so that the second hinge opening 355 and the first hinge opening 351 are arranged on the same axis.

Once the second hinge portion 354 is aligned with the first hinge portion 350, the lock 370 is moved from the unlatched position to the latched position, where a portion of the lever 530 of the lock 370 is positioned within the lock recess 353 defined on the first hinge portion 350. When the lock 370 is moved into the latched position, the lock actuates the carrier block 380 into the unblocking configuration. The lock actuation surface 534 of the lever 530 contacts the actuation pin 390 so that the actuation pin 390 applies force on the lever actuation portion 382 of the carrier block 380. The force applied on the lever actuation portion 382 causes the carrier block 380 to rotate about the carrier block axis 520 so that the carrier block 380 is moved into the unblocking configuration in which the carrier block 380 is not positioned within the first hinge opening 351. In some embodiments, the lock 370 is positioned in the latched position before the carrier block 380 is fully positioned in the unblocking configuration. With the carrier block 380 removed from the first hinge opening 351, the bolt carrier group 210 is able to move rearwardly past the first hinge portion and contact the buffer assembly 320.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A firearm comprising:

an upper receiver defining an upper receiver interior and an upper receiver longitudinal axis;

a lower receiver;

a first hinge portion integral with or coupled to the upper receiver or lower receiver and defining a first hinge opening;

a second hinge portion, wherein said second hinge portion is pivotally connected to said first hinge portion so that said second hinge portion may be configured in a folded configuration or an unfolded configuration with respect to said first hinge portion;

a bolt carrier group, wherein said bolt carrier group is translatable within said upper receiver interior;

a carrier block, wherein said carrier block is configurable in a blocking configuration and an unblocking configuration, and wherein said carrier block is configurable in said blocking configuration when said second hinge portion is configured in said unfolded configuration;

a lock, wherein said lock is configurable into a first position that resists pivoting of the second hinge portion relative to the first hinge portion from a second position in which the lock does not resist pivoting of the second hinge portion relative to the first hinge portion, and wherein said lock actuates said carrier block into said unblocking configuration when said lock is configured into said first position;

wherein said carrier block is in said blocking configuration when said lock is in said second position; and wherein at least a portion of the carrier block is positioned within said first hinge opening when said carrier block is in said blocking configuration; and wherein said carrier block resists rearward translation of said bolt carrier group when said carrier block is in said blocking configuration.

2. The firearm of claim 1, further comprising:

an actuation pin.

3. The firearm of claim 2, wherein said actuation pin applies a force on said carrier block to move said carrier block from said unblocking configuration to said blocking configuration.

4. The firearm of claim 1, wherein said first hinge portion is integral to the lower receiver.

5. The firearm of claim 1, wherein said first hinge opening is aligned with said upper receiver longitudinal axis.

6. The firearm of claim 1, wherein said carrier block is a lever pivotable about a carrier block axis, and wherein said lock is pivotable about a lock axis.

7. The firearm of claim 1, wherein said carrier block is not positioned within said first hinge opening when said carrier block is in said unblocking configuration.

8. The firearm of claim 1, wherein the lock is mounted on said second hinge portion.

9. The firearm of claim 8, wherein the lock is pivotably mounted on said second hinge portion.

10. The firearm of claim 1, wherein said lock enters said first position that resists pivoting of the second hinge portion relative to the first hinge portion before said carrier block is fully in said unblocking configuration.

11. A method of folding a buffer tube assembly of a firearm, said method comprising:

before pivoting a second hinge portion relative to a first hinge portion of the buffer tube assembly, moving a lock from a first condition in which said lock holds the second hinge portion and the first hinge portion in an unfolded position to a second condition which allows said second hinge portion to pivot with respect to said first hinge portion, then pivoting said second hinge portion with respect to said first hinge portion, so that said second hinge portion is positioned in a folded position with respect to said first hinge portion;

wherein said lock is in mechanical communication with a carrier block when said lock is in said first condition; and wherein said carrier block moves into a blocking configuration to resist rearward movement of a bolt carrier group of the firearm simultaneously with said moving of said lock from said first condition to said second condition.

12. The method of claim 11, wherein said lock is pivotable about a lock axis.

13. The method of claim 12, wherein moving said lock comprises pressing a lock button on said lock so that said lock pivots about said lock axis.

14. The method of claim 11, wherein said first hinge portion defines a first hinge opening, and wherein at least a portion of said carrier block is moved into said first hinge opening when said lock is moved from said first condition to said second condition.

15. The method of claim 11, wherein said lock applies a force on an actuation pin when said lock is in said first condition.

16. The method of claim 15, wherein moving said lock from said first condition to said second condition releases at least a portion of said force applied on said actuation pin so that said carrier block rotates about a carrier block axis.

17. The method of claim 11, wherein said lock is not in mechanical communication with said carrier block when said lock is in said second condition.

18. A method of unfolding a buffer tube assembly of a firearm, said method comprising:

pivoting a second hinge portion with respect to a first hinge portion, so that said second hinge portion is moved from a folded position to an unfolded position with respect to said first hinge portion;

moving a lock from a second condition to a first condition in which said lock retains said second hinge portion in said unfolded position with respect to said first hinge portion; and wherein moving said lock from said second condition to said first condition causes a carrier block to move from a blocking configuration that resists rearward movement of a carrier bolt assembly to an unblocking configuration that allows rearward movement of the carrier bolt group; and wherein said lock enters said first condition that retains said second hinge portion in said unfolded position with respect to said first hinge portion before said carrier block is fully in said unblocking configuration.

19. The method of claim 18, wherein said lock pivots about a lock axis when moving from said second condition to said first condition.

20. The method of claim 18, wherein said carrier block pivots around a carrier block axis when moving from said blocking configuration to said unblocking configuration.

21. The method of claim 18, wherein said lock applies a force on an actuation pin when said lock is in said first condition.

22. The method of claim 21, wherein when said lock applies force on said actuation pin, said actuation pin applies a force on said carrier block that causes said carrier block to rotate about a carrier block axis.

23. The method of claim 18, wherein said lock is in contact with said first hinge portion and said second hinge portion when said lock is in said first condition.

* * * * *